United States Patent [19]

Albright

[11] 4,079,822

[45] Mar. 21, 1978

[54] UNLOCKING MECHANISM FOR A VENDING MACHINE

[75] Inventor: Henry J. Albright, West Des Moines, Iowa

[73] Assignee: Fawn Engineering, Des Moines, Iowa

[21] Appl. No.: 737,190

[22] Filed: Nov. 1, 1976

[51] Int. Cl.[2] ..... G07F 5/16

[52] U.S. Cl. ..... 194/48

[58] Field of Search ..... 194/1 L, 2, 48, DIG. 3

[56] References Cited

U.S. PATENT DOCUMENTS 3,149,709 9/1964 Schuller ..... 194/48

*Primary Examiner*—Stanley H. Tollberg

*Attorney, Agent, or Firm*—Henderson, Strom & Sturm

[57] ABSTRACT

A vending machine of a type having a plurality of coin releasable and manually operable pull rods for selectively releasing a product to a consumer. A novel mechanism is provided for selectively locking or releasing the pull rods. This mechanism includes a rod pivotally attached to a frame, the rod being attached to a first lever which is, in turn, operably connected to the pull rod and to a second lever which is, in turn, pivotally attached to a third lever. Structure is provided for causing the third lever to be biased to a position wherein the pull rods are locked; but, upon the insertion of a predetermined amount of money into the vending machine, one of the pull rods can be actuated to release a product due to a changing of the fulcrum of the third lever and simultaneous movement of the third lever and its associated locking structure to thereby unlock one of the pull rods.

4 Claims, 11 Drawing Figures

UNLOCKING MECHANISM FOR A VENDING MACHINE

BACKGROUND OF THE INVENTION

The present invention relates generally to vending machines, and more particularly to a mechanism for selectively locking and unlocking manually operated pull rods on vending machines.

Manually operated vending machines usually have some type of a locking device which prevents a consumer from manually operating the machine until a certain amount of money is inserted into the machine, at which time the locking mechanism is unlocked, thereby allowing the consumer to actuate the machine and receive the product desired. At least one such design of a locking mechanism includes a spring which holds a locking member in place. This spring must be overcome by the weight of the coins inserted therein. It has been determined that such a locking mechanism is not entirely reliable. The problem is that the coins themselves are not very heavy and therefore they do not produce enough energy to positively unlock the machine once the proper amount of money has been inserted therein. In certain of these devices there is also a high friction factor holding the interlocking members together, and it requires too much work to be done by a coin of small mass. Consequently, these prior art devices do not always unlock the vending machine and allow the consumer to receive the desired product as such machines were designed to do.

Consequently, there is a definite need for a locking and unlocking mechanism which does not rely on the weight of the coins for unlocking and furthermore for such a locking device which is reliable and not unduly complicated.

An object of the present invention is to provide an improved locking mechanism for a vending machine.

Another object of the invention is to provide a locking mechanism for a vending machine which is reliable and positive in its locking and unlocking functions.

Still another object of the present invention is to eliminate the need for the weight of coins to overcome springs in such a locking mechanism.

Other objects, advantages and novel features of the present invention will become apparent from the following detailed description of the invention when considered in conjunction with the accompanying drawings.

DESCRIPTION OF THE PREFERRED EMBODIMENT

Figure 1:
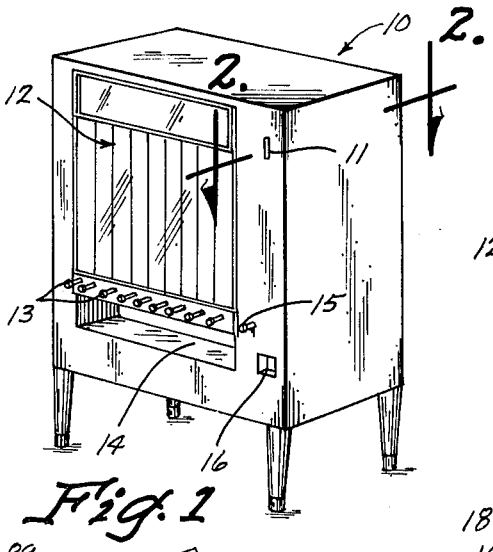
FIG. 1 is a perspective view of a vending machine constructed in accordance with the present invention.

Referring now to the drawings wherein like reference numerals designate identical or corresponding parts throughout the several views, FIG. 1 shows a vending machine 10 constructed in accordance with the present invention. This vending machine 10 has a coin slot 11 therein and item storage units or product columns 12, having respective pull rods 13 under each product column. Each of the pull rods 13 are locked and cannot be pulled outwardly until such time that the proper amount of money is inserted into the coin slot 11. When the proper amount of money is so inserted into the machine, then one of the pull rods 13 can be actuated thereby causing a product to be released in the discharge chute 14. A coin return rod 15 is provided for allowing the consumer to have his money returned into the coin return 16 should he decide not to complete the transaction.

Figure 2:
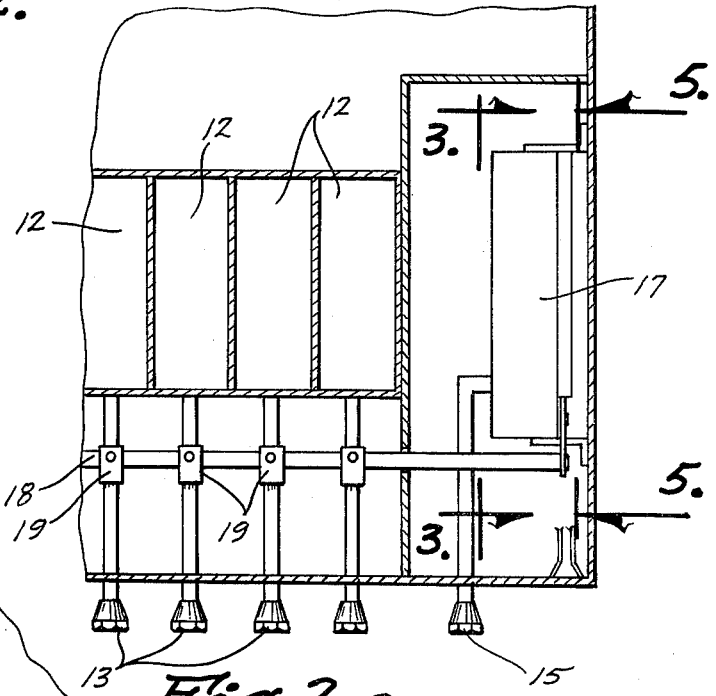
FIG. 2 is a partial cross-sectional view taken along line 2—2 of FIG. 1.

Referring now to FIG. 2, a coinage accumulator 17 is shown attached to the inside frame of the vending machine 10. This coinage accumulator 17 has numerous parts which can be viewed in FIGS. 3-11 and which will now be fully explained. The main purpose of the coinage accumulator 17 is to maintain the vending machine in a locked position until a proper amount of money has been inserted into the vending machine 10 and at which time the vending machine is unlocked so that one of the pull rods 13 can be actuated to release a product.

Figure 3:
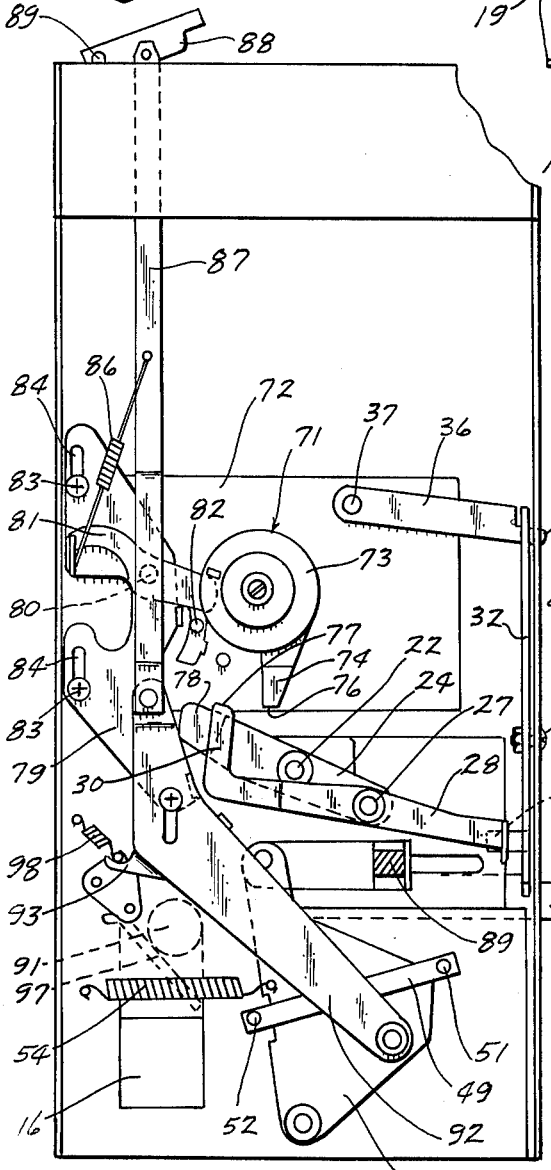
FIG. 3 is a view taken along line 3—3 of FIG. 2.

FIGS. 2 and 3 show a bar 18 which runs across and beneath each of the pull rods 13 and which has captive links 19 connected thereto. These captive links 19 form no part of the present invention, but are units well known in this art which allow only one of the rods 13 to be pulled at one time. It is to be understood that the bar 18 moves with whichever rod 13 is moved; and, accordingly, since it is connected at the other end to member 21, it also causes member 21 to be moved forwardly or rearwardly depending upon the movement of pull rod 13. For the purposes of this invention, we can consider there to be only one pull rod which moves the member 21 forwardly or rearwardly.

Figure 4:
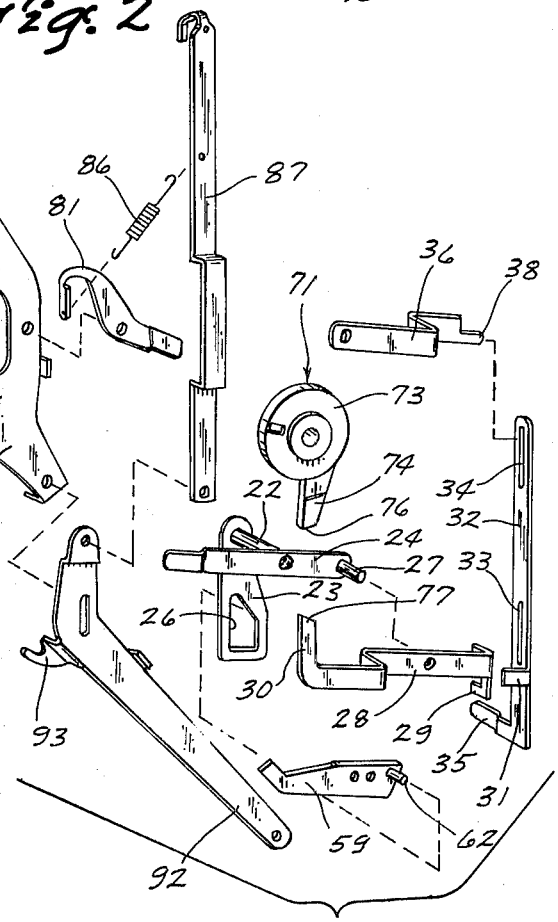
FIG. 4 is an exploded perspective view of the main working parts of the present invention.
Figure 5:
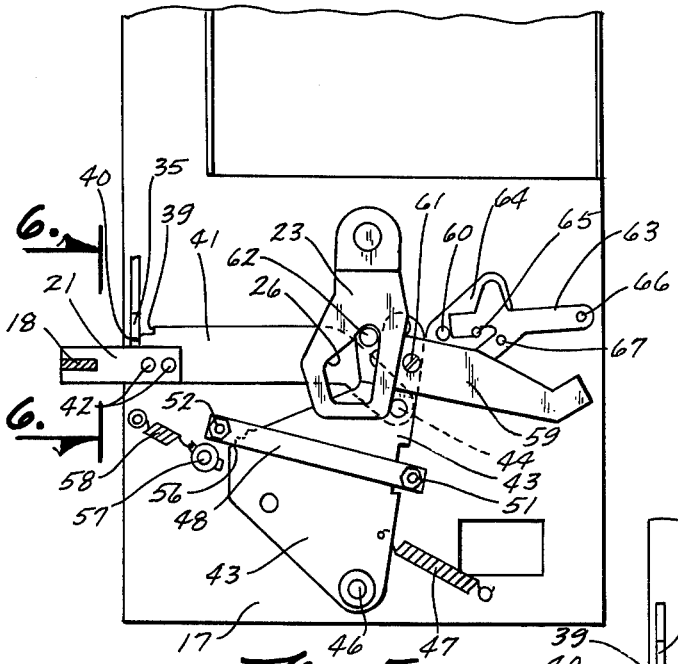
FIG. 5 is a view taken along line 5—5 of FIG. 2.
Figure 8:
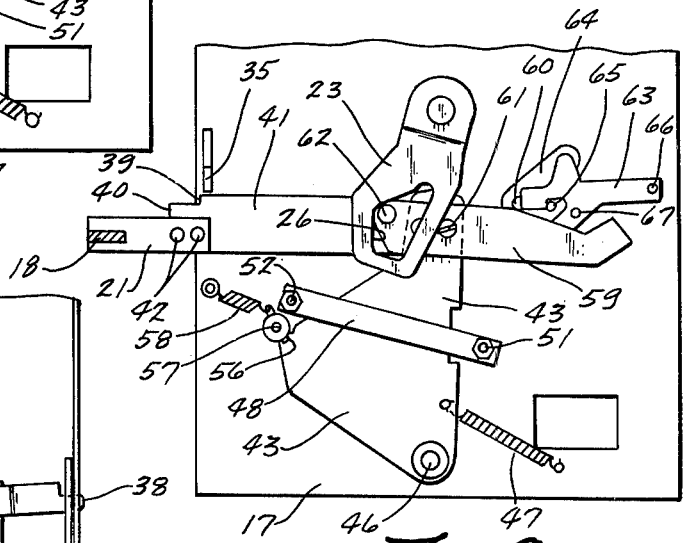
FIG. 8 is a view similar to FIG. 5, but showing the device in an unlocked position.

A rod 22 is pivotally attached to the frame of the coinage accumulator 17 as can clearly be seen in FIGS. 3 and 4. This rod 22 has a first lever 23 rigidly attached to one side thereof and a second lever 24 rigidly attached to the other end thereof. An internally formed camming surface 26 is disposed on the first lever 23 (FIGS. 4, 5 and 8). A pin 27 is attached to one end of the second lever 24, and this pin 27 serves to pivotally attach the second lever 24 to a third lever 28.

This third lever 28 has one end 29 which is turned at right angles with respect to the main portion of third lever 28 and which has a slot therein for reception of a tongue 31. This tongue 31 and groove in end 29 is for the purpose of attaching the member 32 thereto. The member 32 has a pair of slots 33 and 34 therein. A nut and bolt assembly 36 is disposed through the slot 33 and through an opening in the housing of coinage accumulator 17 for the purpose of slidably mounting the member 32 onto the coinage accumulator 17. A pivotal member 36 is pivotally mounted by means of a pin 37 to the coinage accumulator 17 and a projection 38 extends through the slot 34 and member 32 to guide the upper portion of member 32 as it moves up and down as will be discussed below.

Figure 7:
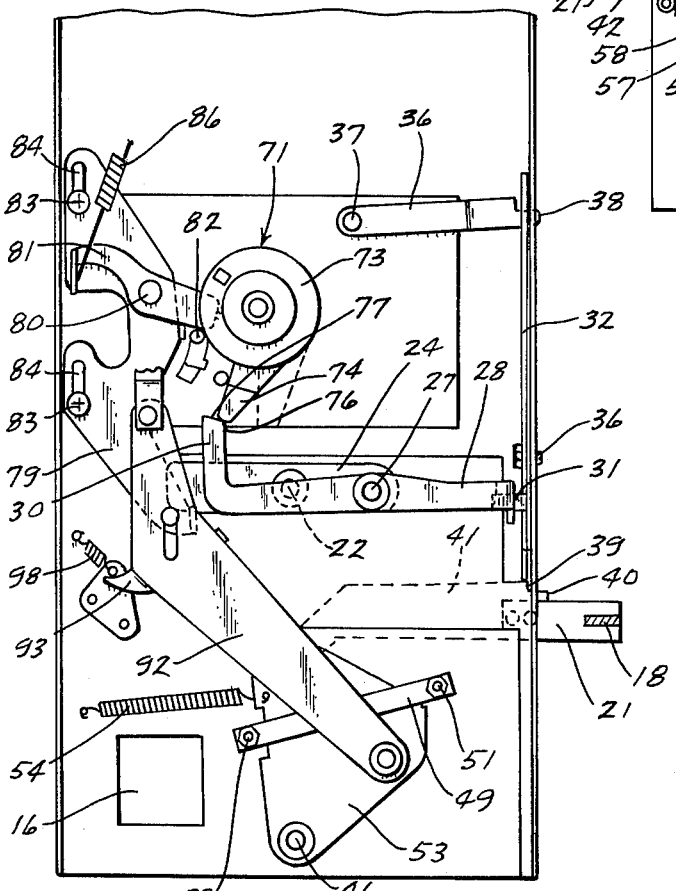
FIG. 7 is a view like FIG. 3, but showing the present invention with enough money in the vending machine so that a product can be released therefrom.
Figure 9:
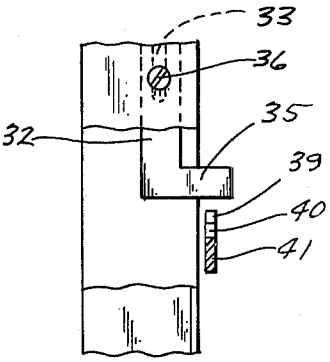
FIG. 9 is a view like FIG. 6, but showing the device in an unlocked position.
Figure 10:
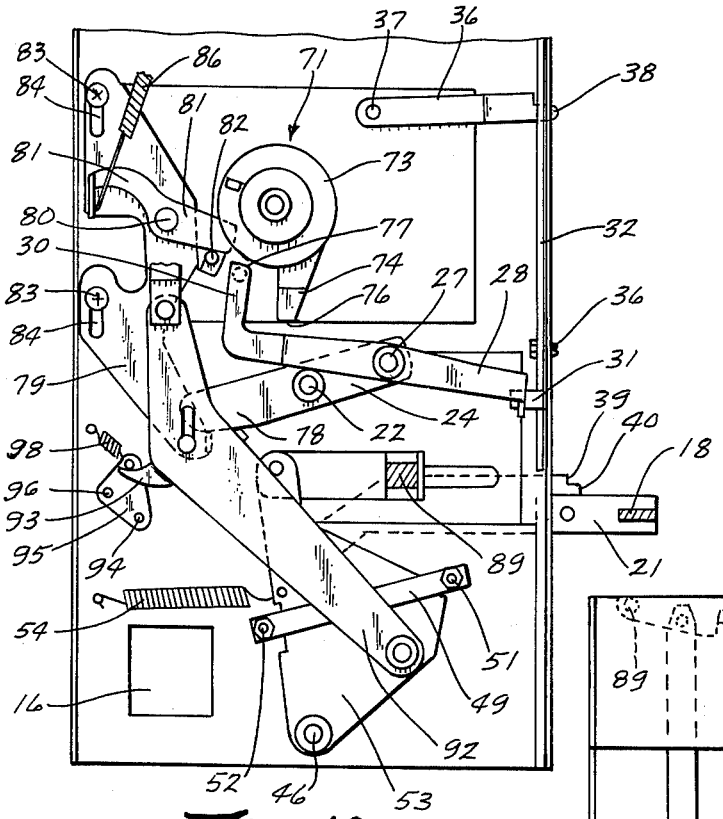
FIG. 10 is a view like FIG. 3, but showing the vending machine completely actuated so as to release a product therefrom.
Figure 11:
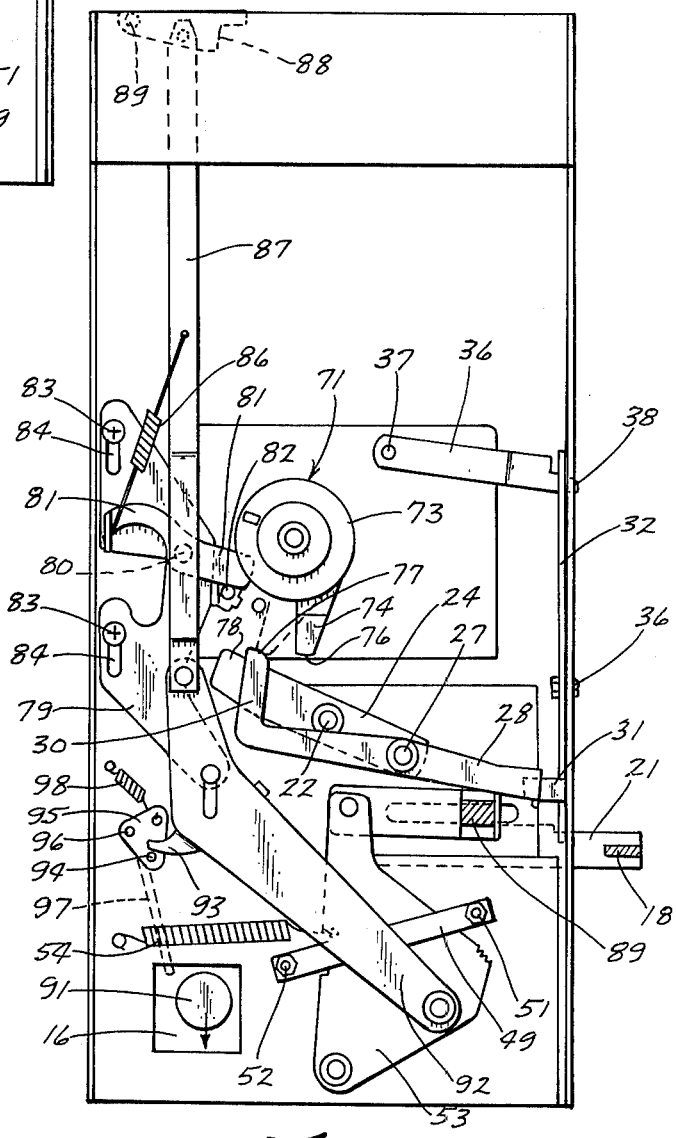
FIG. 11 is a view like FIG. 3, but showing the coin return mechanism actuated so as to return the coin to the consumer and to clear the credit from the machine.

Referring to FIGS. 8–10, it can be seen that a pair of abutment surfaces 39 and 40 are associated with the member 21. Actually the member 21 is connected to a second member 41 by means of rivets 42. The member 41 is, in turn, attached to a member 43 by means of a pin 44. The member 43 is, in turn, pivotally attached to the housing 17 by a pin 46. This member 43 is biased in a clockwise direction by a tension spring 47 attached at one end to the coinage accumulator 17 and at the other end to the member 43. A pair of bars 48 and 49 (FIGS. 7 and 8) are attached to the frame of coinage accumulator 17 by means of nut and bolt assemblies 51 and 52. These bars 48 and 49 serve primarily as a means for stabilizing the movement of members 43 and 53, which members 43 and 53 are pivotally attached to the coinage accumulator 17 frame, but on opposite sides thereof by the pin 46. It is to be noted that a spring member 54 is attached at one end to the frame of 17 and at the other end to member 53 to tend to bias the member 53 in a counterclockwise direction as seen in FIGS. 7, 10 and 11.

Referring again to FIG. 5, a plurality of teeth 56 are disposed on the member 43 for cooperation with member 57, which is spring biased to the position shown in FIG. 5 by means of a tension spring 58 connected on one end to the frame of 17 and at the other end to the member 57. This structure including members 56–58 do not constitute a part of this invention, and are merely a means for preventing someone from pulling a rod only partially out and not completing the vend, as is well known in this art.

A member 59 (FIG. 5) is pivotally attached by means of a pin 61 to the top portion of the member 43. This member 59 has a cam following pin 62 rigidly attached to one end thereof, and which pin 62 projects into the cam opening 26 of the member 23.

Referring now to the structure on the other side of the coinage accumulator 17 in FIGS. 3, 7, 10 and 11, a coin information cam unit 71 has a control section 72 associated therewith. This structure is conventional and well known in the art, for rotating the coin information cam unit 71 to a position as a function of the amount of money inserted into the vending machine. U.S. Pat. Nos. 2,435,933; 2,613,791; 3,139,167; 3,545,586 and 3,797,626 all illustrate devices which are capable of performing this function. The coin information cam unit 71 has a first circular member 73 and a second member 74. The second member 74 has a cam surface 76 disposed on one end thereof for contact with the surface 77 on the end of second lever 28 for reasons which will be explained below.

Figure 6:
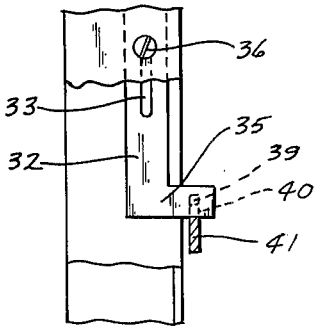
FIG. 6 is a partial cross-sectional view taken along line 6—6 of FIG. 5 showing the device in a locked position.

In operation, when no money, or an insufficient amount of money, is in the machine, the coin information cam unit 71 and consequently the second member 74 will be spaced from the surface 77 of the second member 28 and the member 28 will be biased downwardly to the positions shown in FIGS. 3, 5 and 6 by virtue of the weight bearing on it by members 32 and 36, as well as by the weight of member 28 to the right of the pin 27 as viewed in FIG. 3. Because of this downward bias, the projection 35 of member 32 will be downwardly against the member 21 or 41 and thereby be adjacent to one of the abutment surfaces 39 and 40. When the member 35 (FIG. 6) is in such a position, the pull rod 13 cannot be pulled outwardly because it is linked to the member 18 which is, in turn, linked to the members 21 and 41 which are locked in place by the member 35. By pulling on the member 21 (FIG. 3) by virtue of pulling a pull rod 13, the member 41 tends to want to pivot the member 43 (FIG. 5) in a counterclockwise direction, which, in turn, causes member 59 to be moved accordingly, and consequently the cam following pin 62. During such movement the first lever 23 and the second lever 24 will be pivoted accordingly. But, because member 28 is freely pivotally attached to the member 24, the member 28 will remain down and consequently the member 35 will remain locked against the abutment surface 39 or 40 regardless of any slight movement of members 23 and 24 due to the pulling of a pull rod 13.

If a proper amount of money has been inserted into the vending machine however, the coin information cam unit 71 will be moved to the position shown in FIG. 7, whereby the cam surface 76 of member 74 is adjacent to the surface 77 of the third lever 28. Once this has been done and the pull rod 13 is pulled outwardly, slight movement of the pull rod will cause member 21, through various linkages and pin 62 to rotate the first lever 23 gradually from the position shown in FIG. 5 to the position shown in FIG. 8. As this movement occurs and accordingly the second lever 24 is pivoted as can be seen by the movement from FIG. 3 to FIG. 7 of member 24, the third lever 28 is not allowed to merely pivot and hold the tab 35 against the abutment surface 39 or 40 (as when 74 is in the position of FIG. 3); but, instead, the fulcrum of the third lever 28 is changed from the center thereof to the end 77 thereof and consequently the third lever is pivoted upwardly to the position shown in FIG. 7. This causes the member 32 and locking tab 35 to be moved upwardly such that the locking tab 35 clears the abutment surfaces 39 and 40 as clearly shown in FIG. 9. Consequently, the pull rod 13 is free to be pulled to its outwardmost position with respect to the machine, thereby causing a product within one of the chambers 12 to be released into the discharge chute for completing a transaction with the consumer.

As the pull rod 13 is pulled to its extreme outward position, the device will be substantially as shown in FIG. 10, wherein the end 78 of second lever 24 pushes the member 79 downwardly from the position shown in FIG. 7 to the position shown in FIG. 10, and this movement causes the member 81 to also be moved downwardly against a peg 82, which operates to clear the credit off of the coin information cam unit 72, as is well known in this art, and thereby return the coin information cam unit from the position shown in FIG. 7 to the positions shown in FIGS. 3 and 10.

It is to be understood that the structure associated with members 79 and 81 is substantially conventional in this art, but such structure will be referred to briefly. For example, screws 83 are provided for insertion into grooves 84 and member 79 for the purpose of reciprocally mounting member 79 to the coinage accumulator unit 17. A tension spring 86 is attached at one end to a member 87 and at the other end to member 81 for the purpose of preventing too much pressure from being exerted on the peg 82. In other words, the member 81 could be rigidly attached to the member 79, but by pivotally mounting it by a pin 80 and biasing it to the position shown in FIG. 3 by spring 86, it can be used to contact the member 82 to apply sufficient force when necessary to clear the coin information cam unit 71 without fear of applying too much pressure against the peg 82. The member 87 is pivotally attached at the top thereof to a lever 88 which is, in turn, pivotally attached to the coinage accumulator frame by a pin 89 as is also conventional in this art. Of course, when the member 81 pushes the projection 82 downwardly to clear the credit off of the coin information cam unit 71, the coins placed in the machine will be deposited into the coin box (not shown) for access to the vending machine owner or operator only.

When it is desired by the consumer to have his coins returned before completing a transaction with the vending machine, the coin return lever 15 is pulled, which lever 15 is connected to the coin return connection 89 (FIG. 3). When the coin return rod 15 is pulled outwardly, it causes the member 53 to be pivoted from the position shown in FIG. 3 to the position shown in FIG. 11. This movement also causes the member 81, through member 87, to depress the member 82 in order to erase the credit on the coin information cam unit 71. This clearing of the machine occurs just prior to the coin 91 being returned to the consumer. In other words, as the member 53 is pivoted from the position shown in FIG. 3 to the position shown in FIG. 7, the member 92, which is pivotally attached to member 53 by pin 90, is moved downwardly, which pulls the member 81 downwardly through member 87. During this downward movement, the member 81 clears the coin information cam unit 71 by contacting the member 82. Continued pivoting of the member 53, and consequently continued movement of the member 92 downwardly, causes the projection 93 to contact projection 94 on member 95. This member 95 is pivotally attached by pin 96 to the coinage accumulator frame 17. The member 95 has a coin holding lever 97 rigidly attached thereto, and the member 95 is biased by a tension spring 98 to the position shown in FIG. 3. The tension spring 98 is rigidly attached at one end to the frame of 17 and at the other end to one corner of member 95. As the member 92 moves downwardly from the position shown in FIG. 3 to the position shown in FIG. 11, the member 93 contacts the projection 94, which causes the members 95 and 97 to pivot from the position shown in FIG. 3 to the position shown in FIG. 11, thereby allowing the coin 91 to drop into the coinage return box 16. During all of this operation, the vending machine rods 13 remain locked because the locking tab 35 remains in the downward position against one of the abutment surfaces 39 and 40.

Accordingly, it can be appreciated that the preferred embodiment does indeed accomplish all of the objects set forth above. Obviously many modifications and variations of the present invention are possible in light of the above teachings. It is therefore to be understood that, within the scope of the appended claims, the invention may be practiced otherwise than as specifically described.

I claim:

1. A locking mechanism for a vending machine comprising:

a frame;

means attached to the frame and having a first and a second position, for releasing an article from the vending machine when said releasing means is moved from the first to the second position thereof, said releasing means including an abutment surface; and means for selectively locking said releasing means comprising:

a rod pivotally attached to said frame;

a first lever rigidly attached to said rod;

means for connecting said first lever to said releasing means;

a second lever rigidly attached to said rod;

coin operated means having a shaft rotatable in response to monetary coins inserted therein, the position of said shaft being a function of the amount of money inserted into the vending machine;

a coin information cam unit including a first member fixed on said shaft for rotation therewith, and a second member attached to said first member and having a cam surface disposed thereon;

a third lever pivotally attached intermediate the ends thereof to said second lever;

means disposed on one end of said third lever for contacting the abutment surface of said releasing means;

means for biasing said third lever to a position whereby said one end is adjacent said abutment surface of said releasing means, thereby preventing said releasing means from being moved from the first to the second position thereof when less than a predetermined amount of money is inserted into the vending machine; and means disposed on the other end of said third lever for contacting said cam surface when a predetermined amount of money is deposited in the vending machine and said releasing means is moved from the first towards the second position thereof whereby said one end of said third lever will be moved away from the abutment surface of said releasing means thereby allowing the releasing means to move from the first to the second position thereof.

2. A locking mechanism as defined in claim 1 wherein said connecting means comprises an internally formed camming surface on said first lever and a cam following member attached to said releasing means in contact with said internally formed camming surface.

3. A locking mechanism as defined in claim 1 wherein said biasing means comprises means for causing said one end of said third lever to have more weight on it than said other end of the third member.

4. A locking mechanism as defined in claim 1 wherein said releasing means includes a pull rod which is axially movable between said first and second positions.

* * * * *